United States Patent [19]

Lynd et al.

[11] Patent Number: 5,048,705

[45] Date of Patent: Sep. 17, 1991

[54] BOTTLE AND DRINKING TUBE ASSEMBLY

[75] Inventors: L. Grant Lynd; Paul G. Bordner, both of Pickerington, Ohio

[73] Assignee: Lynd Properties, Inc., Pickerington, Ohio

[21] Appl. No.: 485,818

[22] Filed: Feb. 26, 1990

Related U.S. Application Data

[63] Continuation of Ser. No. 318,231, Mar. 3, 1989, abandoned.

[51] Int. Cl.[5] ..... A47G 21/18; B65D 47/28; B65D 55/16

[52] U.S. Cl. ..... 215/1 A; 215/229; 220/90.2; 222/211

[58] Field of Search ..... 215/1 A, 100 R, 11.1, 215/11.5, 229, 309; 220/90.2, 90.4; 224/148; 222/211, 215, 522, 525, 95, 107

[56] References Cited

U.S. PATENT DOCUMENTS

| | | | |
|---|---|---|---|
| 2,052,307 | 8/1936 | Kennedy | 215/229 X |
| 2,608,841 | 9/1952 | Rice | 65/13 |
| 2,805,001 | 9/1957 | Biederman | 222/525 X |
| 2,815,879 | 12/1957 | Hermes | 215/12.1 |
| 3,173,566 | 3/1965 | Talbert | 215/79 |
| 3,262,613 | 7/1966 | Miller | 222/522 |
| 3,372,846 | 3/1968 | Berkus | 222/525 X |
| 3,774,813 | 11/1973 | Vanderveen | 222/211 |
| 3,840,153 | 10/1974 | Devlin | 215/1 A X |
| 4,252,256 | 2/1981 | Walsh | 215/1 A X |
| 4,286,735 | 9/1981 | Sneider | 222/211 X |
| 4,428,498 | 1/1984 | Obey | 220/367 |
| 4,428,508 | 1/1984 | Gardikas et al. | 222/211 X |
| 4,448,316 | 5/1984 | Hiroshige | 215/100 R X |
| 4,557,401 | 12/1985 | Hodge | 222/211 |
| 4,700,861 | 10/1987 | Neward | 215/309 |

FOREIGN PATENT DOCUMENTS

| | | | |
|---|---|---|---|
| 899473 | 12/1953 | Fed. Rep. of Germany | 222/525 |
| 3047185 | 7/1982 | Fed. Rep. of Germany | 222/211 |

*Primary Examiner*—Sue A. Weaver

*Attorney, Agent, or Firm*—Robert E. Stebens

[57] ABSTRACT

A bottle and drinking tube assembly is provided for dispensing of liquids. The bottle has an open top body formed from a resilient plastic material and is adapted to be collapsed upon application of moderate hand pressure and a cap for closing the top through which the bottle is filled. An aperture is formed in the cap for receiving an elongated drinking tube that extends to the bottom of the bottle and has an end exterior of the bottle from which the liquid is discharged. A fluid seal is formed between the cap and tube. A selectively operable venting valve is also provided in the cap to alternatively permit airflow into the bottle enabling the user to sip the liquid through the tube or to prevent fluid outflow from the bottle when the bottle is collapsed to forcibly expel liquid through the tube.

26 Claims, 4 Drawing Sheets

46
45a
45
45b
49
48
55
54
56
50
52
51
42
44
41
43
47
53
40
21

24
22
23
21
40
45
41
42
49
55
53
4
4
46
43
48
47
30
36
5
5
34
32
25
29
19
28
26
27
14
25

BOTTLE AND DRINKING TUBE ASSEMBLY

This is a continuation of co-pending application Ser. No. 07/318,231 filed on Mar. 3, 1989, now abandoned.

FIELD OF THE INVENTION

This invention relates in general to a bottle designed specifically for utilization by athletes in providing of water or other liquid during the time that they participating in sports activities. It relates more specifically to a collapsible-wall bottle having a drinking tube through which the user obtains liquid from the bottle and the bottle is provided with a venting device to permit withdrawal of the liquid by the alternative modes of operation of either sipping of the liquid through the tube or cooperative collapsing of the bottle wall to forcibly expel quantities of liquid through the tube.

BACKGROUND OF THE INVENTION

Athletes engaged in participating in strenuous sports activities must frequently drink water or other desired fluids during the course of their activities. This is necessary to maintain the body fluid level at a desired state in view of the relatively high physiological consumption of fluids as a consequence of muscular exertion and also the loss of such body fluids through the perspiration process. It has become a common practice for such athletes to utilize a personal type bottle which is normally of a one quart size and which, for sanitation purposes and convenience of drinking, is provided with a drinking tube that projects exteriorly of the bottle. The drinking tube is generally provided with an end cap at the exterior end for purposes of sanitation and to prevent entry of debris during such time as the bottle is merely resting on the ground or on any other type of supporting surface. These bottles are generally fabricated from a plastic material with the wall thickness being such that, when desired, the bottle may be partially collapsed in attempting to facilitate the drinking operation.

Athletes have different personal desires as to utilization of the drinking bottles. One type of use is that the user merely places the end of the drinking tube in his mouth and then sips or sucks on the tube to withdraw liquid from the interior from the bottle. This type of use requires either that there be a means to permit inflow of air to the bottle or that the user must intermittently release the tube so that air may then flow into the bottle. This is essential as a vacuum is otherwise generated such that withdrawal of the liquid is substantially prevented after a certain amount of liquid has been withdrawn, this depending upon the quantity of liquid that remains in the bottle and the amount of liquid desired at any particular time. The bottles heretofore available are neither designed nor capable of forming a fluid-tight seal with the drinking tube and a limited amount of air may enter the bottle during a sipping operation, thereby partially alleviating the vacuum problem.

A second major type of use of a bottle of this type is that the athlete squeezes the bottle to forcibly eject the liquid through the drinking tube. This technique of utilization of the drinking bottle requires that the bottle form a liquid-type seal with respect to the drinking tube and otherwise be closed so that collapsing of the flexible wall of the bottle will result in compression of the air in the bottle and thereby attempt to effect the forcible ejection of liquid through the tube. However, as indicated, the bottles heretofore available are not constructed to form a good fluid seal and this squeezing technique is not suitably effective.

While there are the two distinct types of utilization techniques and that generally each individual athlete has their own preference, it is not uncommon that a particular athlete at any specific time may desire to use one or other of the two techniques. The bottles presently on the market and used by athletes do not fully meet the requirements of operation to enable use in accordance with each of the two described techniques. The bottles as constructed do not form a good fluid seal as between the bottle and the drinking tube and thus when the collapsing technique is used, it is not uncommon for a liquid to escape at the juncture of the tube and a cap that is secured to a filling opening of the bottle. Alternatively, while the seal is not fully effective for use with the collapsing technique, the seal is usually sufficiently effective that it does impede inflow of air and thus requires the user to interrupt the drinking procedure at intervals to permit air to flow into the bottle through the drinking tube. Accordingly, the bottles do not provide the desired convenience of operation with each of the two common drinking techniques.

SUMMARY OF THE INVENTION

In accordance with this invention, a bottle and drinking tube assembly is provided for use by athletes and which can be utilized in accordance with either technique of drinking, i.e., either by sipping or by ejection of the liquid through the drinking tube. The bottle embodies a conventional structure and is fabricated from a plastic material such as by a blow molding process. This bottle has a wall structure of a thickness such that it may be collapsed with moderate hand pressure. A relatively large open top is provided with a cap that is removable for purposes of cleaning the bottle as well as rapidly filling it with the desired liquid. In accordance with this invention, the cap structure is provided with an aperture through which the drinking tube may be projected and has a fluid sealing element to provide a good seal as between the cap and tube to prevent flow of air or the liquid through this aperture and around the tube. Additionally, the cap is provided with a venting device which may be selectively operated to provide either an opening for admitting air into the bottle for the sipping type of operation or which can be closed to form a fluid-tight seal and thus permit positive pressure to be built up in the container by collapsing the container wall and thus eject fluid through the drinking tube.

In accordance with this invention, the aperture provided in the cap is of a design to permit the drinking tube to be axially displaced therethrough to a desired position and to then retain the tube at that selected position. This aperture includes a sealing element that performs this desired function.

A venting device is provided by this invention in combination with the bottle and cap to perform the aforestated functions and is positioned in the cap and of a configuration such that it may be readily manipulated by the user. The embodiment of the venting device shown is of a type that can be described as a push-to-close and pull-to-open construction. It is of a construction involving a valving element that will frictionally interfit into a valve body formed in the cap and will frictionally interfit to hold the valving element either in the open or the closed position. This valve enables the user to place the container and drinking tube assembly in a condition such that it may be operated and used in accordance with either of the two described drinking techniques, i.e., either sipping or forcible ejection of the liquid.

These and other objects and advantages of this invention will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENTS

Figure 1:
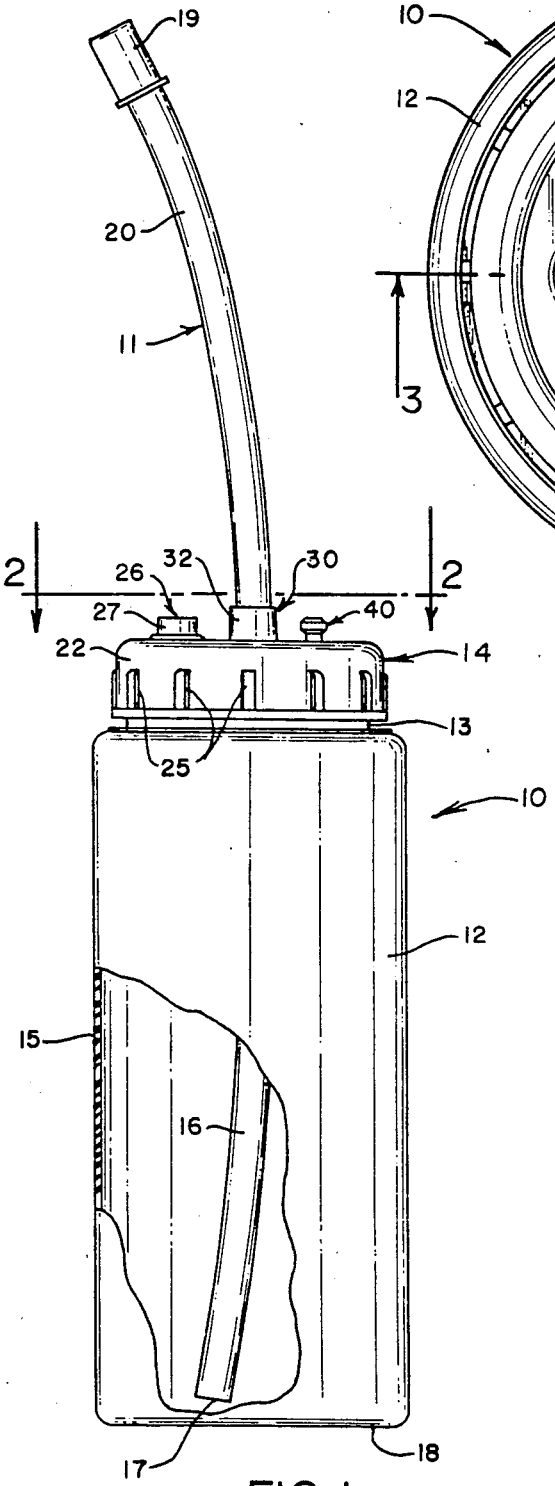
FIG. 1 is an elevational view of a bottle and drinking tube assembly embodying this invention.
Figure 2:
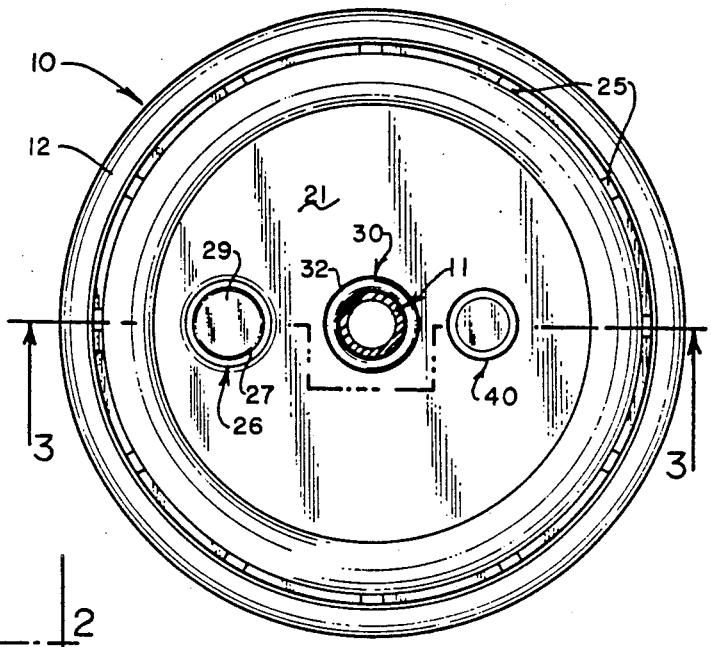
FIG. 2 is a sectional view on a substantially enlarged scale taken along line 2—2 of FIG. 1.

Referring to FIG. 1 of the drawings, an embodiment of the invention is shown and is seen to include a bottle 10 and a drinking tube 11 in assembled relationship. This bottle 10 is of a conventional configuration and includes a body portion 12 of elongated cylindrical configuration having a relatively large opening at the top defined by a neck structure 13. This neck structure is not shown in greater detail, but does include a screw thread which is designed to interengage with an internal thread formed on the interior of a cap 14 adapted to be removably applied to the bottle. While the illustrative embodiment of the cap and bottle is shown and illustrated as having a screw thread type of interconnection, it will be understood that other means of interconnecting caps and bottles may be employed such as the twist lock type of interconnection.

The bottle 10 as indicated is advantageously formed by a blow molding process from a suitable type of plastic material. The particular material that is used is of a type having characteristics of resilience and memory such that when the wall structure is collapsed and the pressure is removed, the wall structure will return to its original configuration. Such a bottle structure also has a relatively thin wall 15 throughout a substantial part of the body portion 12.

The drinking tube 11 is of a suitable length such that when it is inserted through the cap 14 it will have a first end portion 16 extending interiorly of the bottle with a terminal end 17 disposed closely adjacent the bottom wall 18 of the bottle. The drinking tube is fabricated from a suitable plastic and having an outside diameter of the order of ⅜" and a wall thickness of the order of 1/32". A typical bottle 10 has dimensions of the order of 3½" diameter with a length of the order of 10" such that it will have a capacity in the range of one quart or one liter. A protective end cap 19 is preferably provided for removable positioning over the outer terminal end of a second end portion 20 of the tube 11 extending exteriorly of the bottle to prevent entry of debris as well as to assure that liquid will not flow out in the event that the bottle is inadvertently tipped over on its side. This end cap 19 comprises a short tubular section closed at its one end and of a diameter to frictionally interfit over the drinking tube 11 and, when pressed onto the tube, will be retained in position. The outer or second end portion of the drinking tube is of a length to provide convenient spacing as between the terminal end that is placed in the user's mouth and the bottle which is held in the hand.

Figures 3, 4:
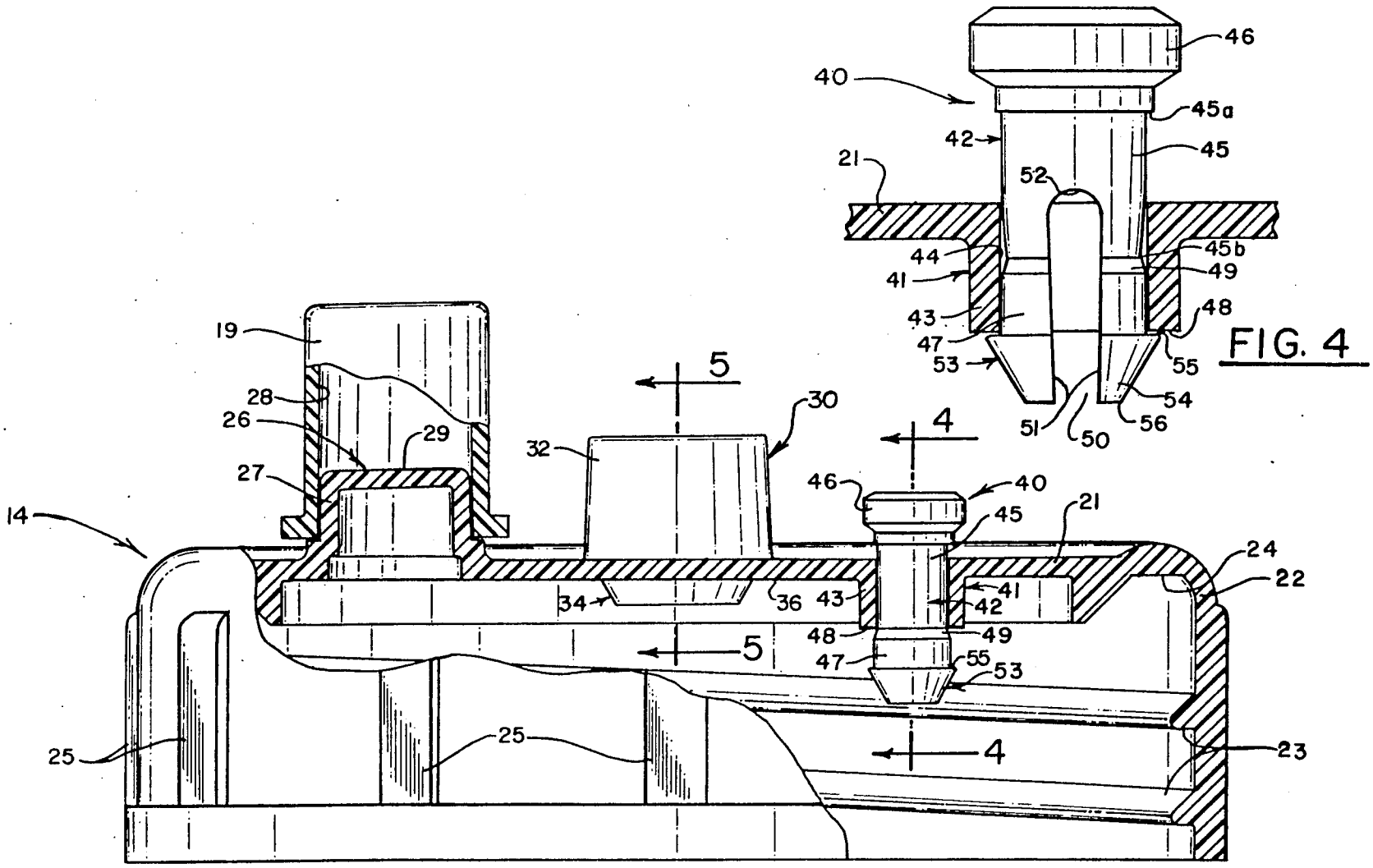
FIG. 3 is a side elevational view partly in section on a further enlarged scale of the cap.
FIG. 4 is a sectional view on a further enlarged scale taken along line 4—4 of FIG. 3.

Specifics of structure of the cap 14 are illustrated in greater detail in FIGS. 2, 3, 4 and 5 and reference may be had to those Figures in addition to FIG. 1. The cap comprises a flat, top wall 21 that is interconnected with a circular ring or flange 22 that is adapted to fit over and mechanically interengage with the neck structure 13. As can be seen in FIG. 3, the interior surface of the flange 22 is provided with an integrally molded screw thread 23 designed to cooperatively interfit with a mating screw thread formed on the exterior of the neck structure 13. This neck structure is of a vertical extent such that an upper edge is adapted to interengage with a sealing surface 24 formed on the inner side of the top wall 21. Turning of the cap onto the neck structure will cause the threads to pull the cap down tightly onto the neck structure and form the sealed engagement to prevent fluid flow as between the cap and the neck. A number of short vertically extending ribs 25 are formed in uniformly angularly spaced relationship around the exterior of the flange 22. These ribs are intended to provide a better means of gripping the cap to either remove or apply the cap. Other types of frictional surface treatment may be utilized for this purpose.

For convenience in utilization of the bottle an end cap retainer 26 is integrally molded with the top wall 21 of the cap. This retainer 26 is designed to interfit with the protective end cap 19 and to thus hold that end cap when it is removed from the end of the drinking tube and thereby prevent its loss. This retainer comprises a relatively short tubular section 27 that is of a diameter to frictionally interfit with the inner wall surface 28 of the end cap. An end wall 29 is provided to close the tubular section 27. A person using this drinking bottle may prefer to place the end cap 19 on the retainer 26 rather than merely hold the cap. This also better assures that the protective end cap will not be inadvertently lost or dropped onto the ground.

Figure 5:
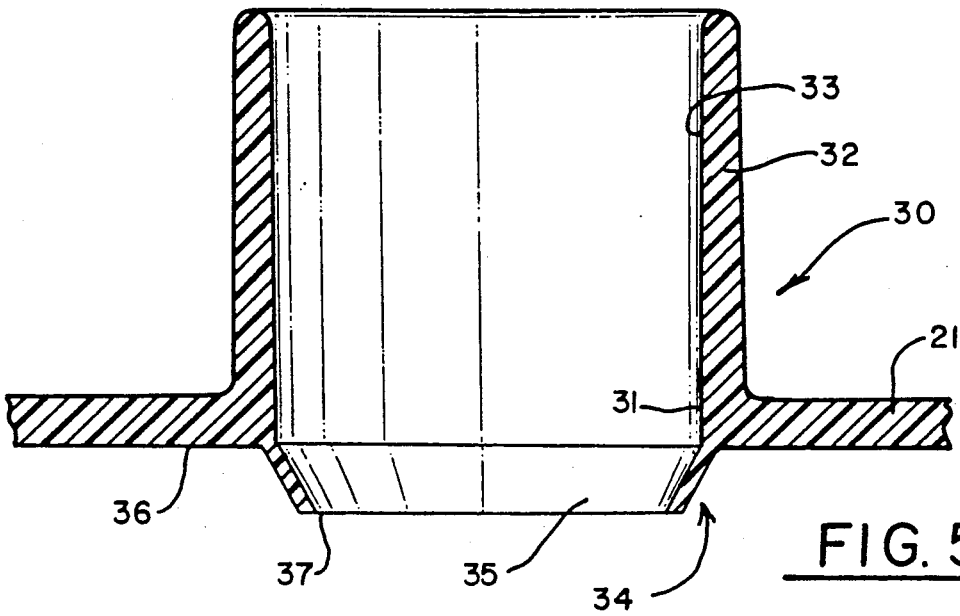
FIG. 5 is a sectional view on a further enlarged scale taken along line 5—5 of FIG. 3.
Figure 6:
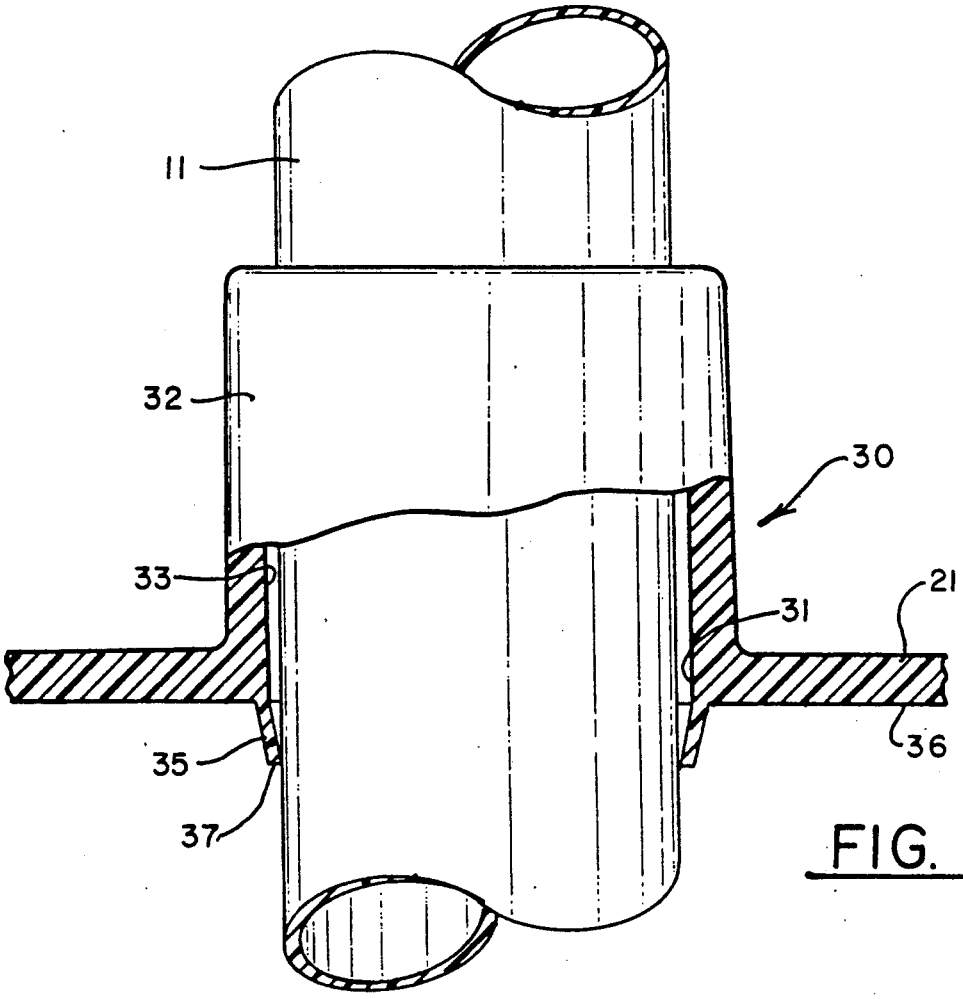
FIG. 6 is a sectional view similar to FIG. 5, but showing a fragmentary section of the drinking tube inserted in this structure.

An aperture designated generally by the numeral 30 for enabling the drinking tube 11 to be inserted into the bottle 10 and to also perform the function of forming a fluid seal as between the bottle and the drinking tube is shown. In this particular embodiment, the aperture 30 comprises a structure that is integrally formed with the cap 14 and more specifically with the top wall 21 of the cap. The basic aperture structure includes a circular opening 31 that is formed in the top wall 21 of the cap and is identified in FIG. 5. In this particular embodiment, the opening 31 is slightly larger than the external diameter of the drinking tube 11 and thus the tube may be readily passed through the opening. A tubular sleeve 32 is provided in association with the aperture 30 and is integrally formed with the top wall 21 of the cap and projects a distance upwardly therefrom. Referring to FIGS. 5 and 6, it will be seen that the sleeve 32 is formed with an internal wall 33 that is of the same diameter as the opening 31. This sleeve 32, while being of relatively short vertical extent, does provide lateral support for the drinking tube and prevents it being twisted to any significant extent at this point of passing through the cap and to better assure that the fluid seal will not be destroyed. Sealing means 34 is provided in association with the aperture 30 and comprises an annular ring 35 of frusto-conical shape. This ring is integrally formed with the top wall 21 of the cap and is of a relatively thin cross-section such that as a consequence of the resilient characteristic of the plastic material, the ring may be expanded in size to mechanically interengage with the outer wall surface of the drinking tube 11 whereby it will perform the combined function of forming a fluid seal and to also mechanically retain the tube at a selected position. The ring 35 is joined to the cap 14 at the juncture of the inner surface 36 of the top wall 21 and the circular opening 31. It projects a short distance inwardly of the top wall 21 terminating in an end ring 37 of circular configuration and adapted to mechanically engage with the outer surface of the drinking tube 11. As can be best seen in FIG. 5, the frusto conical ring 35 is formed such that its configuration results in the end ring 37 being of a diameter that is normally less than the outer diameter of the drinking tube. Accordingly, when the drinking tube is inserted through the aperture 30, it will cause the ring 35 to be flexed outwardly resulting in the resilient force maintaining the tube 11 in frictional supporting engagement and forming the fluid seal.

In accordance with this invention, venting means 40 is provided to permit selective functioning of the bottle and drinking tube assembly in either of the two aforedescribed modes of operation, namely sipping or forcible ejection of the liquid. In this illustrative embodiment, the bottle 10 is provided with the venting means 40 mounted or formed in association with the cap 14. This venting means 40 comprises a selectively operable valving device that includes a valve body 41 and a valving element 42. The valve body 41 comprises a short tube 43 that is integrally formed with the cap's top wall 21 and projects a distance inwardly of the inner surface 36. An opening is formed in the wall 21 forming a continuation of the inner wall surface 44 of the valve body. The valving element 42 is of elongated, rod-like form adapted to be disposed in and to extend axially through the valve body 41. This valving element 42 includes an axially extending section 45 having its opposite ends designated by the numerals **45*a* and 45*b*. This section 45 has a slightly tapered configuration with the larger diameter being at the point 45*a*. Thus, the valving element 42 when inserted into the valve body 41 will result in a frictional interference fit when it is displaced to a first or closed position as is shown in FIG. 3. FIG. 4 illustrates the valving element 42 displaced to a second or open position where the wall 21 at the uppermost corner may contact the outer surface. The relative diameters of the valving element 42 and the inner wall surface 44 of the valve body are such that there will be a slight distortion of the section 45 through interaction with the adjacent contacting portions of the wall 21 when it is placed in the first or closed position as shown in FIG. 3. To facilitate manipulation of the valving element 42, an enlarged head 46 is integrally formed at the upper end of the section 45** and which may be readily gripped by a person's fingers.

Integrally formed at the opposite end of the tapered section 45 is an end portion 47 having a diameter that is slightly greater than that of the bore extending through the valve body. As can be best seen in FIG. 3, the tapered section 45 of the valving element is of a length such that when it is displaced to the first or closed position, the end **45*b* is at least aligned with the inner end 48 of the tube 43. The end portion 47 is thus projected entirely into the interior of the cap or bottle. It is preferably joined with the tapered section 45 by a frusto conical section 49 that facilitates entry of the end portion 47 into the bore 44 when the valving element 42** is pulled upwardly.

An axially extending channel 50 is formed in the valving element 42 to permit fluid flow when the valving element is displaced to its second or open position as shown in FIG. 4. This channel 50 in the illustrative embodiment comprises a transverse slot that opens at diametrically opposite sides of the tapered section 45 and the end portion 47 as well as opening to the internal end or interior of the bottle. This channel has spaced side walls 51 terminating in an arcuately curved end wall 52 and extends a distance axially through the valving element such that when it is disposed in the second or open position as shown in FIG. 4, the channel will permit fluid flow with the respect to the exterior of the cap wall 21. Accordingly, fluid may then flow into the bottle or out of the bottle, as the case may be, with the objective being that air may flow into the bottle to relieve any vacuum that would otherwise be built up by a person sipping the fluid from the bottle through the tube 11.

This slot-form channel 50 has another function in the mechanical operation of the venting means. Since it extends transversely through the valve body, it permits the opposite sections of the body to be collapsed inwardly as is the case when the element is pulled upwardly to the second position and the enlarged end portion 47 is drawn into the bore 44. When in this position as shown in FIG. 4, the resilient characteristic of the plastic material from which the valving element 42 is formed causes a frictional force to be developed between the interengaging surfaces of the end portion 47 and the inner wall surface of the bore 44. This frictional force serves to retain the valving element in this second position.

Locking means 53 is advantageously provided at the end of the valving element that is disposed in the interior of the cap or bottle. This illustrative locking means comprises a frusto-conical shaped section 54 having its base or larger diameter at a juncture with the end portion 47. The section 54 at its base is of a slightly larger diameter than that of the end portion 47 and thus defines an annular ring 55 which will engage with the end wall 48 of the tube 43 if the valving element 42 is pulled upwardly to a sufficient extent. In FIG. 4, the valving element is shown to have this surface 55 spaced from the end wall for purposes of clarity of illustration. The lowermost or smaller diameter end 56 of the conical section 54 is of a diameter substantially less than that of the bore 44. This configuration facilitates assembly of the valving element with the valve body. If the valving element is completely removed, it is simply inserted by forcing the frusto-conical section 54 into the bore and with the channel 50 permitting collapse of the opposed sections, the element may be inserted through the valve body. Once the valve element is in the assembled position, the frusto conical section 54 serves to lock the element in place and effectively prevents its inadvertent removal.

Figure 7:
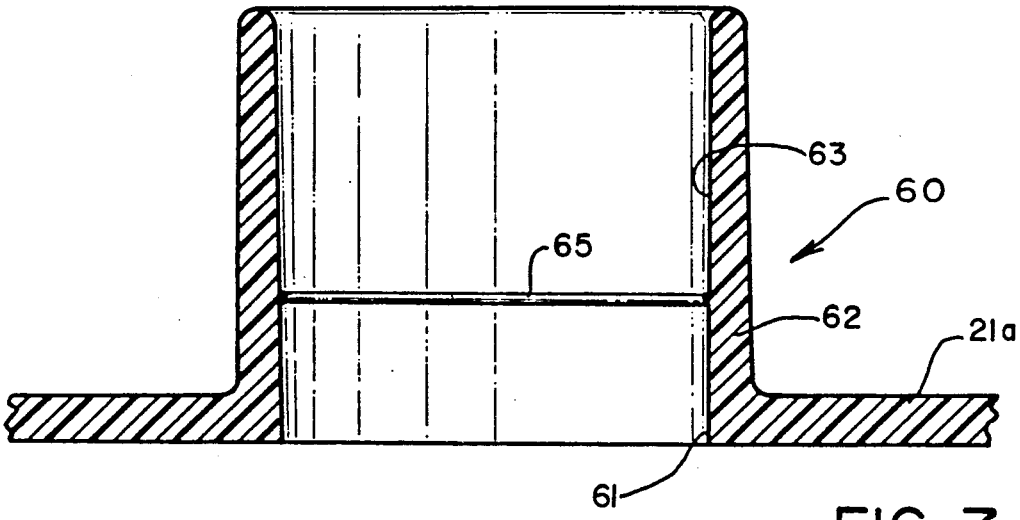
FIG. 7 is a sectional view similar to FIG. 5, but showing a modified construction for the aperture receiving the drinking tube.
Figure 8:
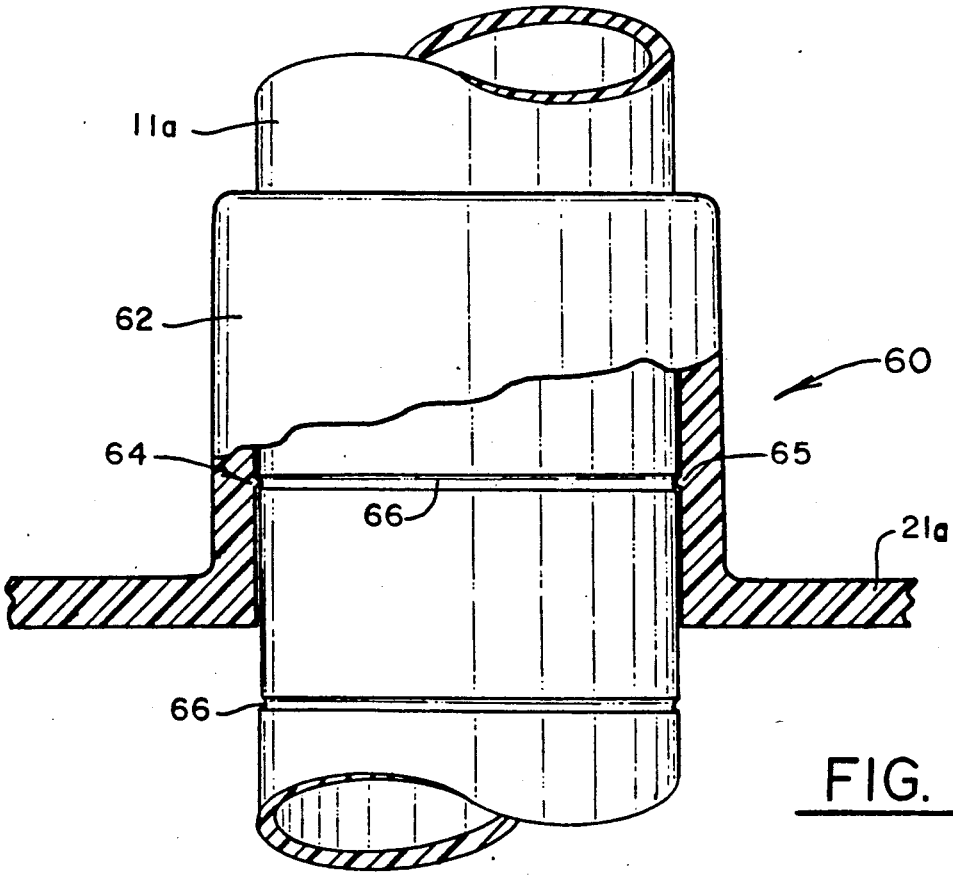
FIG. 8 is a sectional view similar to FIG. 7, but showing a fragmentary section of the drinking tube inserted into the aperture.

A modified aperture for assembly with a drinking tube 11 is shown in FIGS. 7 and 8 and designated generally by the numeral 60. This aperture 60 is also shown as being integrally formed with the top wall 21*a* of a cap structure. Formed in this cap wall 21*a* is a circular opening 61 which is dimensionally close to that of the exterior diameter of a drinking tube 11*a*. A tubular sleeve 62 is integrally formed with the cap top wall 21*a* and projects a distance vertically upward therefrom. This sleeve 62 has an internal wall surface that is coaxial with and of substantially the same diameter as the circular opening 61. Accordingly, the sleeve 62 performs the same function of providing lateral support to the drinking tube as in the case of the first illustrated embodiment. Sealing means 64 is also provided to form a fluid seal as between the aperture and the drinking tube. This sealing means also performs the mechanical function of interlocking the components together and retain the drinking tube at a desired position. Forming the sealing means 64 are cooperatively configured rings 65 and grooves 66. These rings and grooves are formed in the illustrative embodiment with a semicircular configuration and dimensionally related such that the rings will interfit into a respective one of the grooves and form a fluid seal with respect thereto. Only one ring 65 is provided in this embodiment and it is shown as integrally formed with the sleeve 62 at an elevation above the circular opening 61 defined with respect to the wall 21*a*. This ring may be located at other positions and may be located at the lower end in alignment with the bottom edge surface of the cap wall 21*a*. Two grooves 66 are shown formed on the outer wall of the drinking tube 11*a* in axially spaced relationship. This permits the drinking tube to be displaced axially and positioned at a selected location. The number of such grooves that are formed on the tube are dependent on the particular circumstances of operation or selectivity that is to be provided in locating the terminal end of the tube within the body of liquid contained in the bottle. While the illustrative embodiment shows the ring being formed on the interior surface of the sleeve and grooves formed on the wall of the tube, this relationship could be reversed. Similarly, additional rings could be formed on the tube to provide selectivity in axially positioning of the tube with respect to the cap and bottom of the bottle.

It will be readily apparent from the foregoing detailed description of the illustrative embodiments of the bottle and drinking tube assembly that a novel and particularly useful device is provided for utilization by athletes. The structure provides the unique ability for the user to obtain fluid from the bottle by either of two modes of operation. The providing of venting means enables the user to select which mode of operation is desired at any particular time and permits the fluid or liquid to be drawn from the bottle either by sipping on the tube or through forceful expulsion of liquid as a consequence of collapsing of the bottle wall. While a single embodiment of venting means is shown and described, it will be readily apparent that other specific venting devices or valves may be provided in this inventive combination to enable the alternative modes of operation as may be selected by the user. It will also be apparent that other structures may be provided for effecting mechanical fixing of the drinking tube in the cap and forming a fluid-tight seal, including permanently fixing the tube to the cap. Also, the aperture for drinking tube or the venting means, or both, may be provided in association with the bottle rather than the cap.

Having thus described this invention, what is claimed is

1. A bottle and drinking tube assembly for drinking of liquids comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture formed in a first wall portion thereof for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof maybe placed in a person's mouth; and (C) venting means carried by said bottle and selectively operable to either a first position to prevent fluid flow into or from said bottle or to a second position to permit inflow of air into said bottle, said venting means including a venting passageway formed in a second wall portion of said bottle and disposed in spaced relationship to said drinking tube aperture and opening to the exterior and to the interior of said bottle, a valve element linearly slideably positionable with respect to said venting passageway either in a relatively open position to permit air flow through said passageway or in a relatively closed position forming a fluid-sealing relationship therewith preventing fluid flow therethrough, and retention means mechanically cooperable with said valving element for maintaining said valving element in closed, fluid-sealing relationship with said venting passageway when positioned in relatively closed relationship with respect thereto.

2. A bottle and drinking tube assembly according to claim 1 wherein said drinking tube is axially displaceable through said aperture.

3. A bottle and drinking tube assembly according to claim 2 which includes mechanical interengaging means for retaining said tube in a predetermined axially displaced position relative to said aperture.

4. A bottle and drinking tube assembly according to claim 1 wherein said bottle includes a cap, said body portion having an opening formed therein through which said bottle may be filled and emptied of fluid and said cap is removably positionable on said body portion in closing relationship to said opening, said cap and body portion including mechanical means for cooperative interengagement in detachably securing of said cap in closing relationship to said opening and for effecting a fluid-sealed relationship therebetween when said cap is disposed in closing relationship to said opening.

5. A bottle and drinking tube assembly according to claim 4 wherein said aperture is formed in said cap.

6. A bottle and drinking tube assembly according to claim 4 wherein said cap is provided with said venting means.

7. A bottle and drinking tube assembly according to claim 4 wherein said cap is formed with said aperture and provided with said venting means.

8. A bottle and drinking tube assembly according to claim 1 wherein said sealing means is mechanically interengaged between said aperture and said drinking tube.

9. A bottle and drinking tube assembly according to claim 8 wherein said drinking tube is axially displaceable through said aperture and said sealing means is operable to retain said tube in a predetermined axially displaced position relative to said aperture.

10. A bottle and drinking tube assembly for drinking of liquids comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof may be placed in a person's mouth; and (C) venting means carried by said bottle and selectively operable to either a closed position to prevent fluid flow into or from said bottle through said venting means or to an open position to permit inflow of air into said bottle, said venting means including a valve body having a bore opening at opposite axial ends thereof respectively to the interior and the exterior of said bottle, and a valving element of elongated, rod-like form adapted to be disposed in said bore and linearly slideably displaceable axially therethrough between first and second positions with respect to said bore, said valving element formed with an elongated channel extending axially thereof and having a first end which opens to the interior of said bottle and having a second end which is closed when said valving element is disposed in said first position preventing fluid flow therethrough and which is open to the exterior of said bottle when said valving element is disposed in said second position permitting air therethrough.

11. A bottle and drinking tube assembly according to claim 10 which includes retention means for maintaining of said valving element in either of said first or second positions.

12. A bottle and drinking tube assembly according to claim 10 wherein said valving element includes a gripping portion disposed exteriorly of said valve body and said bottle to facilitate manipulation of said valving element.

13. A bottle and drinking tube assembly according to claim 10 wherein said aperture in said bottle for passage of a drinking tube therethrough is formed in a first wall portion of said bottle, and said venting passageway of said venting means is formed in a second wall portion and disposed in spaced relationship to said drinking tube aperture.

14. A bottle and drinking tube assembly for drinking of liquids comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof may be placed in a person's mouth, said drinking tube being axially displaceable through said aperture, said sealing means being mechanically interengaged between said aperture and said drinking tube and operable to retain said tube in a predetermined axially displaced position relative to said aperture and including an annular ring formed from a resiliently flexible material and secured at a first end thereof to said bottle in coaxial relationship to said aperture, said ring extending radially inward of said opening to project a second end thereof into mechanical contact with said drinking tube and forming a frictional and fluid sealing engagement therewith; and (C) venting means carried by said bottle and selectively operable to either a first position to prevent fluid flow into or from said bottle or to a second position to permit inflow of air into said bottle, said venting means including a venting passageway opening to the exterior and to the interior of said bottle, a valving element selectively positionable with respect to said venting passageway either in a relatively open position to permit air flow through said passageway or in a relatively closed position forming a fluid-sealing relationship therewith preventing fluid flow therethrough, and retention means mechanically cooperable with said valving element for maintaining said valving element in closed, fluid-sealing relationship with said venting passageway when positioned in relatively closed relationship with respect thereto.

15. A bottle and drinking tube assembly according to claim 14 wherein said annular ring is of a frusto-conical configuration.

16. A bottle and drinking tube assembly for drinking of liquid comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture and an elongated sleeve disposed in coaxial relationship to said aperture for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof may be placed in a person's mouth, said drinking tube being axially displaceable through said aperture and sleeve, said sealing means being mechanically interengaged between said aperture and sleeve and said drinking tube and operable to retain said tube in a predetermined axially displaced position relative to said aperture and sleeve, said sealing means including at least one annular ring formed from a resiliently flexible material and secured in fixed relationship at a first end thereof to one o said sleeve and said tube and extending radially therefrom to project a second end thereof into mechanical contact with the other of said tube and sleeve and forming a frictional and fluid sealing engagement therewith; and (C) venting means carried by said bottle and selectively operable to either a first, position to prevent fluid flow into or from said bottle or to a second position to permit inflow of air into said bottle, said venting means including a venting passageway opening to the exterior and to the interior of said bottle, a valve element selectively positionable with respect to said venting passageway either in a relatively open position to permit air flow through said passageway or in a relatively closed position forming a fluid-sealing relationship therewith preventing fluid flow therethrough, and retention means mechanically cooperable with said valving element for maintaining said valve element in closed, fluid-sealing relationship with said venting passageway when positioned in relatively closed relationship with respect thereto.

17. A bottle and drinking tube assembly for drinking of liquids comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture for passage of a drinking tube therethrough and sealing means for effecting a fluid-sealed relationship between said bottle and said drinking tube;

(B) an elongated drinking tube of a caliber through which a person may drink liquid, said tube extending through said aperture end having a first end portion projected a distance interiorly of said bottle to have at least a marginal end portion thereof immersible in a body of liquid that may be disposed in said bottle and a second end portion extending a distance exteriorly of said bottle whereby a marginal end portion thereof may be placed in a person's mouth, said drinking tube being axially displaceable through said aperture, said sealing means being mechanically interengaged between said aperture and said drinking tube and operable to retain said tube in a predetermined axially displaced position relative to said aperture, said sealing means being formed with at least one pair of interfitting annular rings and grooves forming mechanical and fluid sealing engagement therebetween; and (C) venting means carried by said bottle and selectively operable to either a first position to prevent fluid flow into or from said bottle or to a second position to permit inflow of air into said bottle, said venting means including a venting passageway opening to the exterior and to the interior of said bottle, a valving element selectively positionable with respect to said venting passageway either in a relatively open position to permit air flow through said passageway or in a relatively closed position forming a fluid-sealing relationship therewith preventing fluid flow therethrough, and retention means mechanically cooperable with said valving element for maintaining said valving element inclosed, fluid-sealing relationship with said venting passageway when positioned in relatively closed relationship with respect thereto.

18. A bottle and drinking tube assembly according to claim 14 wherein said aperture includes an elongated sleeve disposed in coaxial relationship to said aperture, one of said pair of rings and grooves formed on the interior of said sleeve with the other of said pair formed on said tube.

19. A bottle and drinking tube assembly for drinking of liquids comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof may be placed in a person's mouth; and (C) venting means carried by said bottle and selectively operable to either a closed position to prevent fluid flow into or from said bottle through said venting means or to an open position to permit inflow of air into said bottle, said venting means including a valve body having a bore opening at opposite axial ends thereof respectively to the interior and the exterior of said bottle, and a valving element of elongated, rod-like form adapted to be disposed in said bore and selectively displaceable axially therethrough between first and second positions with respect to said bore, and which includes an axially extending section formed with a slightly tapered wall whereby said section mechanically engages with said bore in frictional engagement when disposed in said first position to retain said valving element in said first position and form a fluid seal between said valving element and said valve body, said valving element formed with an elongated channel extending axially thereof and having a first end which opens to the interior of said bottle and having a second end which is closed when said valving element is disposed in said first position preventing fluid flow therethrough and which is open to the exterior of said bottle when said valving element is disposed in said second position permitting air flow therethrough.

20. A bottle and drinking tube assembly according to claim 19 wherein said channel terminates at an intermediate point of said tapered axially extending section whereby it is closed when said valving element is displaced to said first position,

21. A bottle and drinking tube assembly according to claim 19 wherein said channel comprises an elongated, axially extending slot opening transversely at opposite sides of said valving element, and at an end thereof facing the interior of said bottle.

22. A bottle and drinking tube assembly according to claim 21 wherein said valving element is of a length to have a marginal end portion projecting out of said valve body into the interior of said bottle when said valving element is displaced to said first position, and positioned in said bore when said valving element is displaced to said second position, said marginal end portion being of a diameter slightly larger than the bore of said valve body whereby it will frictionally interengage therewith and retain said valving element in said second position

23. A bottle and drinking tube assembly according to claim 22 wherein said valving element includes locking means formed at said end projecting interiorly of said bottle to resist withdrawal of said valving element from said valve body.

24. A bottle and drinking tube assembly for drinking of liquids comprising (A) a closed bottle for containing quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof maybe placed in a person's mouth; and (C) venting means carried by said bottle and selectively operable to either a first position to prevent fluid flow into or from said bottle or to a second position to permit inflow of air into said bottle, said venting means including a venting passageway opening to the exterior and to the interior of said bottle, a valving element linearly slideably positionable with respect to said venting passageway either in a relatively open position to permit air flow through said passageway or in a relatively closed position forming a fluid-sealing relationship therewith preventing fluid flow therethrough, and retention means mechanically cooperable with said valving element for maintaining said valving element in closed, fluid-sealing relationship with said venting passageway when positioned in relatively closed relationship with respect thereto.

25. A bottle and drinking tube assembly for drinking of liquids comprising (A) a closed bottle for containing a quantity of liquid that may be selectively dispensed therefrom, said bottle including a body portion having a wall structure of original configuration formed with a predetermined thickness from a material to be flexible, thereby enabling at least portions of said wall structure to be inwardly collapsed under moderate hand pressure to reduce the internal volume of the bottle to effect dispensing of liquid, said wall structure having the characteristic of resilience whereby it will return to its original configuration upon removal of collapsing force, said bottle having an aperture for passage of a drinking tube therethrough and sealing means for effecting a fluid-sealed relationship between said bottle and said drinking tube;

(B) an elongated drinking tube of a caliber through which a person may drink liquid, said tube extending through said aperture and having a first end portion projected a distance interiorly of said bottle to have at least a marginal end portion thereof immersible in a body of liquid that may be disposed in said bottle and a second end portion extending a distance exteriorly of said bottle whereby a marginal end portion thereof may be placed in a person's mouth; and (C) venting means carried by said bottle and selectively operable to either a first position to prevent fluid flow into or from said bottle or to a second position to permit inflow of air into said bottle, said venting means including a venting passageway opening to the exterior and to the interior of said bottle, a valving element coaxially slideably positionable with respect to said venting passageway either in a relatively open position to permit air flow through said passageway or in a relatively-closed position forming a fluid-sealing relationship therewith preventing fluid flow therethrough, and retention means mechanically cooperable with said valving element for maintaining said valving element in closed, fluid-sealing relationship with said venting passageway when positioned in relatively closed relationship with respect thereto.

26. A bottle and drinking the tube assembly according to claim 25 wherein said valving element and said venting passageway have a common axis along which they are movable relative to each other.

* * * * *